US008651303B1

(12) United States Patent
Groot

(10) Patent No.: US 8,651,303 B1
(45) Date of Patent: Feb. 18, 2014

(54) LOCKING STOPPER COMPONENT

(76) Inventor: Daniel J. Groot, Dunedin, FL (US)

( * ) Notice: Subject to any disclaimer, the term of this patent is extended or adjusted under 35 U.S.C. 154(b) by 464 days.

(21) Appl. No.: 13/134,131

(22) Filed: May 31, 2011

Related U.S. Application Data

(60) Provisional application No. 61/518,198, filed on May 2, 2011, provisional application No. 61/517,969, filed on Apr. 28, 2011, provisional application No. 61/396,804, filed on Jun. 3, 2010.

(51) Int. Cl.
*B65D 55/14* (2006.01)

(52) U.S. Cl.
USPC ..... 215/207; 215/361; 220/210; 220/234; 70/171

(58) Field of Classification Search
USPC ..... 220/210, 233, 234, 238; 215/207, 358, 215/359, 361, 17, 26, 28; 138/89, 90; 70/171
See application file for complete search history.

(56) References Cited

U.S. PATENT DOCUMENTS

| | | | | |
|---|---|---|---|---|
| 3,130,571 | A * | 4/1964 | Neumann | 70/58 |
| 4,035,921 | A | 7/1977 | Williams | |
| D258,871 | S | 4/1981 | Rajotte, Jr. et al. | |
| 4,268,579 | A | 5/1981 | Suzuki et al. | |
| 5,011,319 | A | 4/1991 | Levi et al. | |
| 5,829,153 | A | 11/1998 | Hitchock | |
| 6,883,546 | B1 | 4/2005 | Kobylinski | |
| 7,546,693 | B1 | 6/2009 | Impellizeri | |
| 2007/0131643 | A1 * | 6/2007 | Liao | 215/358 |

* cited by examiner

*Primary Examiner* — Anthony Stashick
*Assistant Examiner* — James N Smalley

(57) ABSTRACT

A locking stopper component has lower, upper and central extents. The lower extent includes a stick. A frusto-conical cam shoulder is formed in a central extent of the stick. The upper extent includes a lock rotatable between locked and unlocked positions and an upper shaft. The central extent operatively coupling the upper and lower extents includes a reciprocating assembly and a rotatable assembly whereby rotating the lock rotates the rotatable assembly and raises the reciprocating assembly to secure the component in a tubular member.

10 Claims, 2 Drawing Sheets

32

36

42

48

50

64
66
52

62

72, 74

88
76
84
82
86

102
100

102

104

108

136

LOCKING STOPPER COMPONENT

RELATED APPLICATION

The present application is based upon U.S. Provisional Application No. 61/396,804 filed Jun. 3, 2010, 61/517,969 filed Apr. 28, 2011 and 61/518,198 filed May 2, 2011 the subject matter of which of applications is incorporated herein by reference.

BACKGROUND OF THE INVENTION

1. Field of the Invention

The present invention relates to an improved locking stopper component and more particularly pertains to selectively locking/sealing and uncovering of a fluid reservoir in a secure tamper-free manner while precluding leakage when the tank/reservoir is tipped into an unintended orientation.

2. Description of the Prior Art

The use of stopper components is known in the prior art. More specifically, stopper components of known designs and configurations previously devised and utilized for the purpose of precluding leakage of and tampering with fluids from tanks/reservoirs are known to consist basically of familiar, expected, and obvious structural configurations, notwithstanding the myriad of designs encompassed by the prior art which has been developed for the fulfillment of countless objectives and requirements.

In this respect, this locking stopper component according to the present invention substantially departs from the conventional concepts and designs of the prior art, and in doing so provides an apparatus primarily developed for the purpose of selectively locking/sealing and uncovering of a fluid reservoir in a secure tamper-free manner while precluding leakage when the tank/reservoir is tipped into an unintended orientation and with contracting sealing components for ease of insertion and removal.

Therefore, it can be appreciated that there exists a continuing need for a new and improved locking stopper component which can be used for selectively locking/sealing and uncovering of a fluid reservoir of a tank while precluding leakage when the reservoir is tipped into an unintended orientation. In this regard, the present invention substantially fulfills this need.

SUMMARY OF THE INVENTION

In view of the foregoing disadvantages inherent in the known types of stopper components of known designs and configurations now present in the prior art, the present invention provides an improved locking stopper component. As such, the general purpose of the present invention, which will be described subsequently in greater detail, is to provide a new and improved locking stopper component and method which has all the advantages of the prior art and none of the disadvantages.

To attain this, the present invention essentially comprises an upper extent, a lower extent, and a central extent between the upper and lower extents. The component has a normally vertical central axis. The component is in an essentially symmetrical configuration about the central axis.

The lower extent includes an elongated dipstick with a frusto-conical cam shoulder formed in a central extent of the dipstick. The dipstick has a radial bore there through above the shoulder.

The upper extent includes a lock. A key is provided for insertion into the lock for rotation between locked and unlocked positions. The upper extent also includes an upper shaft having a threaded recess above for threadedly receiving the lock. The lock has a square projection below. A flat washer or seal and a spring insure the sealed positioning of the upper shaft and the lock.

The central extent includes a reciprocating assembly and a rotatable assembly.

The reciprocating assembly is formed of a split cylinder, a sealing cylinder, and a cam cylinder. The sealing cylinder is located above and exteriorly of the split cylinder. The cam cylinder is located beneath and interiorly of the split cylinder. The cam cylinder has a downwardly facing spiral surface in contact with the shoulder of the central rotatable member whereby rotation of the central rotatable member and cam shoulder will cause the cam shoulder to ride along the spiral surface to translate the rotational movement of the shaft and cam shoulder into axial reciprocating movement of the reciprocating assembly. A lower split ring encircles the split cylinder at a lower extent.

The rotatable assembly is formed of an interior drum above and an exterior drum below and the upper shaft and the dipstick. A radial bore extends through the interior drum and the exterior drum and the upper shaft and the dipstick. A cylindrical roll pin extends through the radial bore to ensure concurrent rotational movement of all components of the rotatable assembly and to preclude relative axial movement between components of the rotatable assembly. The exterior drum is formed with an upper chamfer and a lower chamfer. An upper split ring encircles the split cylinder at a lower extent.

Next provided is a sealing assembly formed of an upper sealing component and a lower sealing component. The upper sealing component is located between the upper chamfer and the interior drum. The lower sealing component is located between the lower chamfer and the sealing ring. In this manner, rotational motion of the rotational assembly will translate to axial raising of the reciprocating assembly to compress the O-rings and seal the component in the neck of an oil reservoir.

A repositionable cap is next provided. The repositionable cap is positioned above the interior drum. The repositionable cap has a lower portion with a securement ring. The repositionable cap has a shiftable upper portion. A pivot pin couples the upper and lower portions. An L-shaped leg is formed in the upper portion to contact the securement ring during closing of the repositionable cap. A top O-ring ensures sealing of the upper and lower portions.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved locking stopper component which has all of the advantages of the prior art stopper components of known designs and configurations and none of the disadvantages.

It is another object of the present invention to provide a new and improved locking stopper component which may be easily and efficiently manufactured and marketed.

It is further object of the present invention to provide a new and improved locking stopper component which is of durable and reliable constructions.

An even further object of the present invention is to provide a new and improved locking stopper component which is susceptible of a low cost of manufacture with regard to both materials and labor, and which accordingly is then susceptible of low prices of sale to the consuming public, thereby making such a locking stopper component economically available to the buying public.

Even still another object of the present invention is to provide a locking stopper component for selectively locking/sealing and uncovering of a fluid reservoir of a tank or reservoir in a secure tamper-free manner while precluding leakage when the tank/reservoir is tipped into an unintended orientation.

Lastly, it is an object of the present invention to provide a new and improved locking stopper component having lower, upper and central extents. The lower extent includes a stick. A frusto-conical cam shoulder is formed in a central extent of the stick. The upper extent includes a lock rotatable between locked and unlocked positions and an upper shaft. The central extent operatively coupling the upper and lower extents includes a reciprocating assembly and a rotatable assembly whereby rotating the lock rotates the rotatable assembly and raises the reciprocating assembly to secure the component in a tubular member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
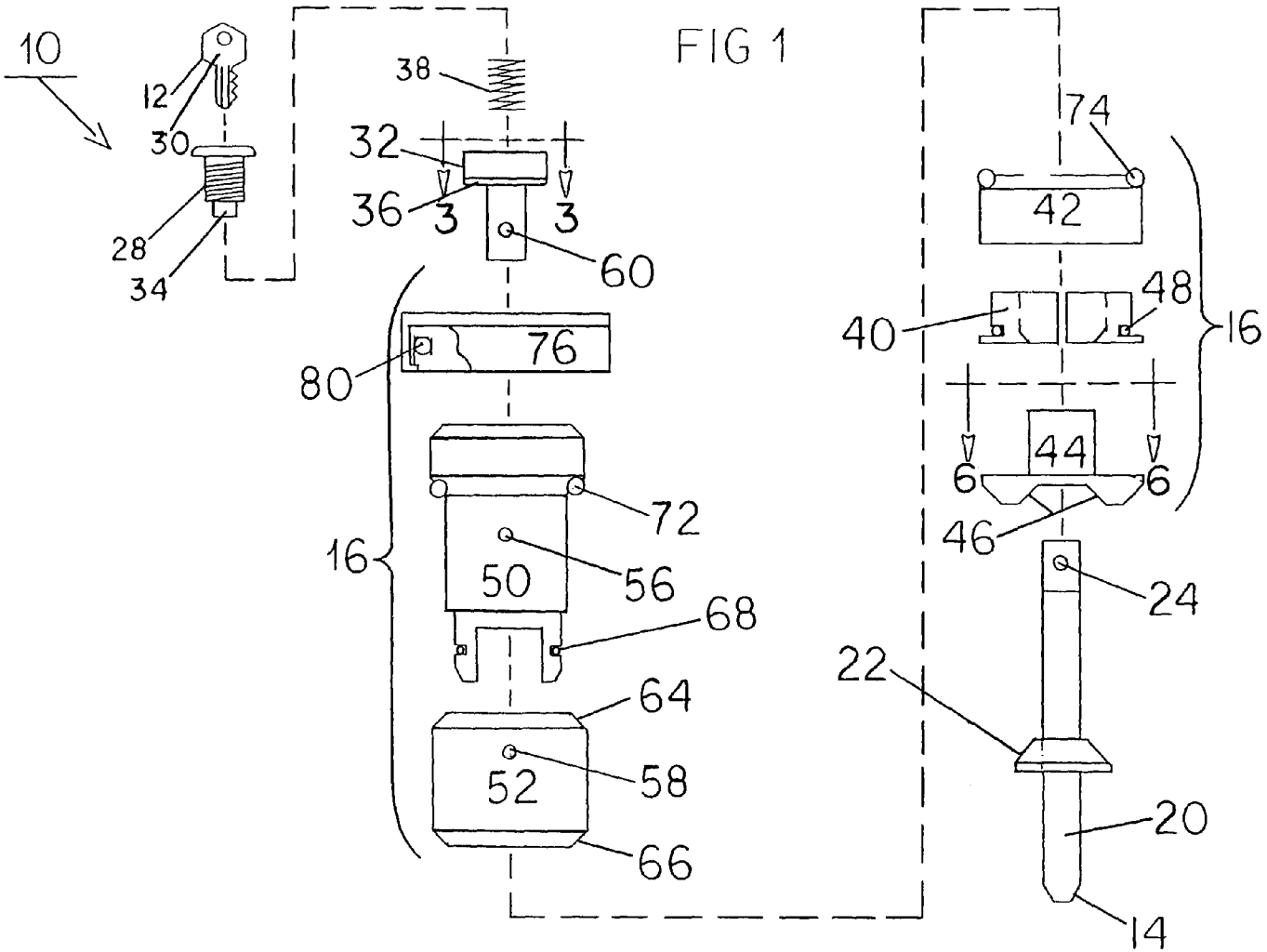
FIG. 1 is an exploded front elevational view of a locking stopper component constructed in accordance with the principles of the present invention.

With reference now to the drawings, and in particular to FIG. 1 thereof, the preferred embodiment of the new and improved locking stopper component embodying the principles and concepts of the present invention and generally designated by the reference numeral 10 will be described.

The present invention, the locking stopper component 10 is comprised of a plurality of components. Such components in their broadest context include an upper extent, a central extent and a lower extent. Such components are individually configured and correlated with respect to each other so as to attain the desired objective.

The locking stopper component 10 is for selectively locking/sealing and uncovering a fluid reservoir of a tank/reservoir in a secure tamper-free manner while precluding leakage when the tank/reservoir is tipped into an unintended orientation. The locking/sealing and uncovering and the precluding leakage is done in a safe, convenient and economical manner.

First provided is an upper extent 12, a lower extent 14, and a central extent 16 between the upper and lower extents. The component has a normally vertical central axis. The component is in an essentially symmetrical configuration about the central axis.

The lower extent includes an elongated dipstick 20 with a frusto-conical cam shoulder 22 formed in a central extent of the dipstick. The central rotating member has a radial bore 24 there through above the shoulder.

The upper extent includes a lock 28. A key 30 is provided for insertion into the lock for rotation between locked and unlocked positions. The upper extent also includes an upper lock housing 50 having a threaded recess above for threadedly receiving the lock. The lock has an oval projection 34 below. A flat washer or seal 36 and a spring 38 insure the sealed positioning of the upper shaft and the lock.

The central extent includes a reciprocating assembly and a rotatable assembly.

The reciprocating assembly is formed of a split cylinder 40, a sealing cylinder 42, and a cam cylinder 44. The sealing cylinder is located above and exteriorly of the split cylinder. The cam cylinder is located beneath and interiorly of the split cylinder. The cam cylinder has a downwardly facing spiral surface 46 in contact with the shoulder of the dipstick whereby rotation of the dipstick and cam shoulder will cause the cam shoulder to ride along the spiral surface to translate the rotational movement of the dipstick and cam shoulder into axial reciprocating movement of the reciprocating assembly. A lower split ring 48 encircles the split cylinder at a lower extent.

The rotatable assembly is formed of an interior drum 50 above and an exterior drum 52 below and the upper shaft and the shaft. A radial bore 56, 58, 60, 24 extends through the interior drum and the exterior drum and the upper shaft and the dipstick. A cylindrical roll pin 62 extends through the radial bore to ensure concurrent rotational movement of all components of the rotatable assembly and to preclude relative axial movement between components of the rotatable assembly. The exterior drum is formed with an upper chamfer 64 and a lower chamfer 66. An upper split ring 68 encircles the split cylinder at a lower extent.

Next provided is a sealing assembly formed of an upper O-ring 72 and a lower O-ring 74. The upper O-ring is located between the upper chamfer and the interior drum. The lower O-ring is located between the lower chamfer and the sealing ring. In this manner, rotational motion of the rotational assembly will translate to axial raising of the reciprocating assembly to compress the O-rings and seal the component in the neck of an oil reservoir.

A repositionable cap 76 is next provided. The repositionable cap is positioned above the interior drum. The repositionable cap has a lower portion. The repositionable cap has a shiftable upper portion 82. A pivot pin 84 couples the upper and lower portions. An L-shaped leg 86 is formed in the upper portion to contact the detent during closing of the repositionable cap. A top O-ring 88 ensures sealing of the upper and lower portions.

Figures 2, 3, 4, 5, 6, 7, 8, 9, 10, 11, 12, 13, 14, 15, 16, 17, 18, 19:
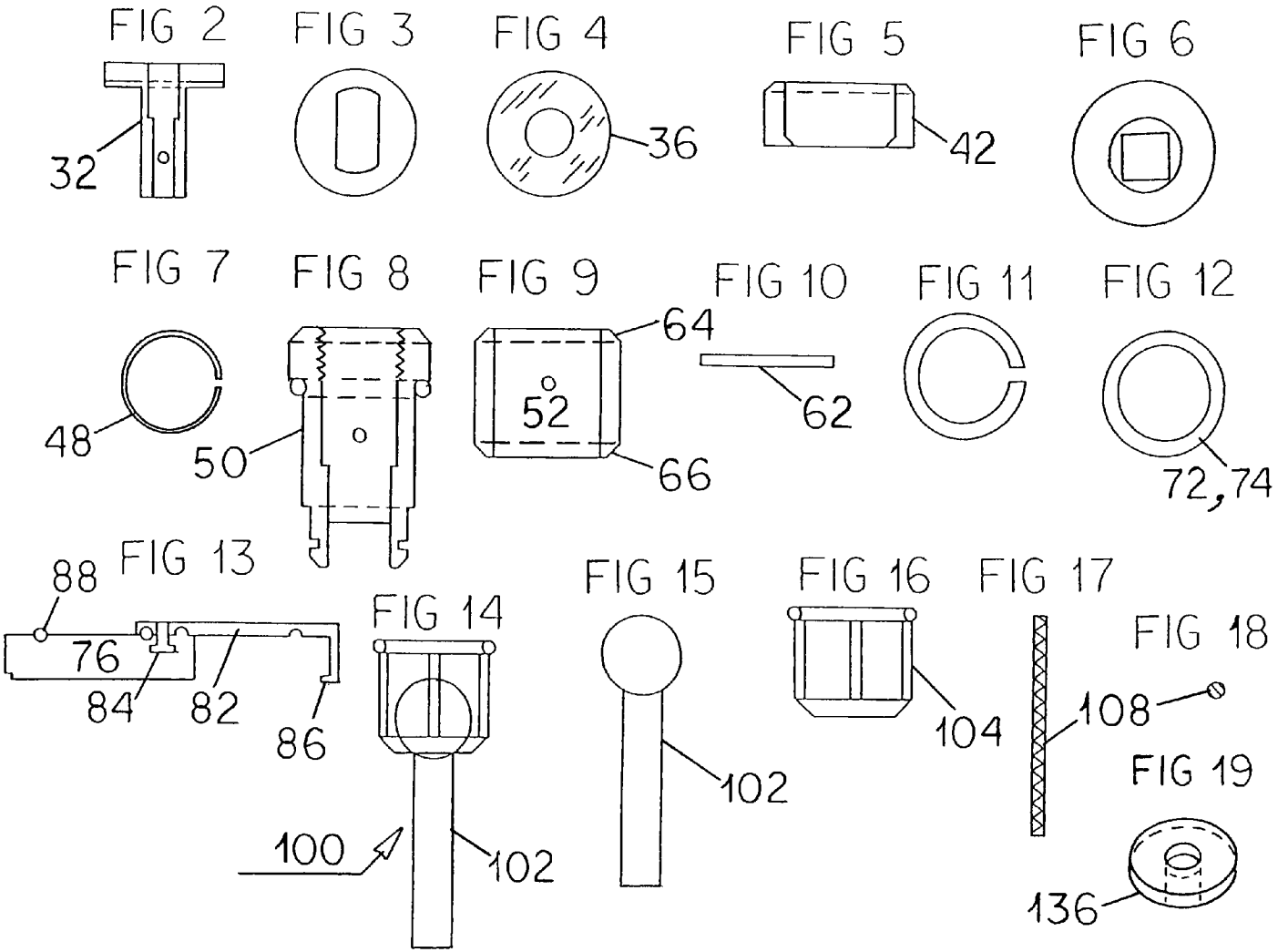
FIG. 2 is a front elevational view of the upper shaft shown in FIG. 1.
FIG. 3 is a plan view of the upper shaft shown in FIGS. 1 and 2.
FIG. 4 is a plan view of the flat washer shown in FIGS. 1 and 2.
FIG. 5 is a front elevational view of the sealing cylinder shown in FIG. 1.
FIG. 6 is a plan view of half of the cam cylinder shown in FIG. 1.
FIG. 7 is a plan view of the lower split ring shown in FIG. 1.
FIG. 8 is a front elevational view of the interior drum shown in FIG. 1 functioning as a lock housing.
FIG. 9 is a front elevational view of the exterior drum shown in FIG. 1.
FIG. 10 is a front elevational view of the cylindrical locking pin.
FIG. 11 is a plan view of a split ring shown in FIG. 1.
FIG. 12 is a plan view of the upper and lower O-rings shown in FIG. 1.
FIG. 13 is a front elevational view of the repositionable cap shown in FIG. 1.
FIGS. 14, 15 and 16 are front elevational views of a dipstick made in accordance with an alternate embodiment of the invention.
FIGS. 17 and 18 area front and end elevational views of a dipstick made in accordance with a final alternate embodiment of the invention.
FIG. 19 is a shaft seal on the center rotating member.

An alternate embodiment of the invention is illustrated in FIGS. 14, 15 and 16. In this embodiment, the stick is an assembly 100 formed of a rigid dipstick 102 formed with a spherical upper end. A cage-like support 104 receives the spherical upper end. In this manner, the rigid dipstick always depends in a vertical orientation under the influence of gravity.

Another alternate embodiment of the invention is illustrated in FIGS. 17 and 18. In this embodiment, the stick is a flexible dipstick 108. In this manner, the flexible dipstick always depends in a vertical orientation under the influence of gravity.

The present invention is a chemical and heat resistant locking stopper component with a repositionable cap 76 for a bore such as a fill tube and having a length with wedges to expand rubber, rubber O-rings 72, 74 or soft metal C-rings or similar, and hard solid ring on the outside of the component. The stopper component is placed in the bore. The key 30 is inserted and the lock 28 turned. The lock is connected to a shaft 20 with a cam 22 located on the shaft. As the shaft turns the cam activates and sends upward pressure on the reciprocating external components 44, 40, 42. As upwards pressure is applied to the reciprocating external components. They compress rubber style O-ring components 72, 74 causing the O-rings to expand and create a better seal. They also cause a hard split ring 48 or similar style component to expand at the end extending beneath the bore or fill tube causing the locking stopper component to be larger at the bottom of the bore and not to be removed from the bore.

The component also has a retained cap 76 that either rotates out and back in place or uses a dove tail sliding type to cover and seal contaminants out of the lock and other parts of the stopper component.

As the key 30 is inserted, and rotated to remove the stopper component, the cam 22, 46 allows the parts 44, 40, 42 that traveled upwards to travel downwards and the rubber style component 72, 74 shrinks and the hard solid ring 48 or similar style shrinks and the stopper component can then be removed from the fill tube.

Elements 30, 28 are a key and a lock.

Element 38 is a spring that fits between the lock and the upper part of the upper shaft 32 to apply pressure to the mating parts of the upper shaft and the lock to create a seal with a soft metal washer 36 in place of a rubber seal.

Element 32 is the upper shaft. FIG. 1 shows the metal washer 36 in place with a threaded or roll pin bore 60 for assembly.

Element 76 is the repositionable cap with FIG. 1 showing the cap in the closed position while attached to the interior drum 50 or, optionally, all in one piece with the interior drum 50.

Element 86 is a catch formed of an O-ring 80 and L-shaped leg 86 that catches and holds these elements of the repositionable cap in a closed orientation.

Element 80 is a soft component such as O-rings under the cap that would allow the stopper component to set on the fill tube of an oil reservoir.

Element 50 is the interior drum.

A tapered ledge is formed in an upper region of the interior tube 50. A round O-ring 72 limits movement of the sealing cylinder 42 and elements above the sealing cylinder.

Surfaces on the shoulder 22 and cam cylinder 44 act to force the split cylinder 40 apart with the upward movement of the split cylinder. The lower end of interior drum is tapered to spread and separate the split cylinder 40.

O-ring 72 is a sealing component, an O-ring with a wedge behind in the upper area.

Element 56 is a bore for use during assembly.

Element 52 is the exterior drum with wedges on top and bottom that mate with O-rings or expanding sealing device so that when pressure is applied, and parts are axially forced together whereby the sealing devices expand and provide a better seal in the fill tube.

Element 42 is a sealing cylinder, another sliding device that has a wedge and a sealing device installed as an O-ring that mates with the exterior drum.

Element 40 is a split cylinder that fits partially inside the sealing cylinder when forced upwardly to a tapered diameter that will not let it be removed from the fill tube.

Element 48 on the split cylinder is a split ring 48 to collapse parts together when there is no pressure forcing the parts upwardly.

Element 44 is a cam cylinder with a male type slot or square that keeps this part from turning and allows the parts to travel upwards to force the parts together.

The upper extent of the cam cylinder 44 is a cam system that forces parts upwards when the other portion of the cam is rotated.

Element 20 is a shaft, shown as a dipstick, that has a cam 22 on it

A roll pin hole 62 extends through pin holes or threaded holes for assembly. The lower part of the shaft is a dipstick.

FIG. 2 shows a cross section of the upper shaft with a bore at the top for the dipstick at the bottom. A recess at the bottom section is for the upper part of the dipstick to go into during assembly.

FIG. 3 shows a top view of FIG. 2 with a bore with two flat sides on it. This arraignment allows the shaft on the lock and the bore in the upper shaft to slide up and down but still have positive rotational movement.

FIG. 4 shows soft metal washer 36 for use in the upper shaft.

FIG. 6 shows top view of the cam cylinder 44 with a male slot or square.

FIG. 13 shows the repositionable cap 76 in an open position with a pivot pin 84 and O-ring 88 or rubber component to seal and apply upwards pressure on cap that holds it in place with the catch.

FIG. 10 shows a roll pin 62 to be used in place of a screw at assembly.

FIG. 7 shows a round split spring 48 to be used on the interior drum and the split cylinder.

FIG. 12 shows a round sealing component 72, 74 such as an O-ring or C-ring.

FIG. 11 shows another style of C clip 68 that could be used in place of round split spring 48.

FIG. 16 shows a mounting device 104 with an interior recess that would attach in a mating place in the housing or at the bottom of an enlarged cam or shaft that would house the swivel dipstick.

FIG. 14 shows a swivel dipstick 100 that would take the place of a shaft/dipstick in the mounting device.

FIG. 15 shows a swivel type dipstick 102.

FIG. 17 shows a cable or other flexible dipstick 108 that would take the place of another dipstick that would attach to the shaft or a swivel type dipstick.

FIG. 18 shows plan view of the flexible dipstick 108.

FIG. 19 is an elastomeric ring 136 functioning as a shaft seal on the center rotating member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A locking stopper component comprising:

a lower extent (14) including a stick (20) with a frusto-conical cam shoulder (22) formed in a central extent of the stick (20);

an upper extent (12) including a lock (28) rotatable between locked and unlocked positions, the upper extent also including an upper shaft (32) receiving the lock; and a central extent (16) operatively coupling the upper and lower extents, the central extent including a reciprocating assembly and a rotatable assembly whereby rotating the lock rotates the rotatable assembly and raises the reciprocating assembly to secure the component in a tubular member.

2. The component as set forth in claim 1 wherein the reciprocating assembly is formed of a split cylinder (40) and a sealing cylinder (42) and a cam cylinder (44), the sealing cylinder (42) being located above and exteriorly of the split cylinder (40), the cam cylinder being located beneath and interiorly of the split cylinder (40), the cam cylinder having a downwardly facing spiral surface (46) in contact with the cam shoulder (22) of the stick (20) whereby rotation of the stick and cam shoulder will cause the cam shoulder (22) to ride along the spiral surface (46) to translate the rotational movement of the stick and cam shoulder into axial reciprocating movement of the reciprocating assembly, a lower split ring (48) encircling the split cylinder (40) at the central extent (16) of the locking stopper component (10).

3. The component as set forth in claim 2 wherein the rotatable assembly includes an interior drum (50) above and an exterior drum (52) below and the upper shaft (32) and the stick, a radial bore extending through interior drum and the exterior drum (52) and the upper shaft and the stick, a cylindrical roll pin extending through the radial bore to ensure concurrent rotational movement of all components of the rotatable assembly and preclude relative axial movement between components of the rotatable assembly, the exterior drum (52) being formed with an upper chamfer and a lower chamfer, an upper split ring (68) encircles the split cylinder (40) at the central extent (16) of the locking stopper component (10).

4. The component as set forth in claim 3 and further including a sealing assembly formed of an upper Elastomeric component and a lower Elastomeric component, the upper Elastomeric component being located between the upper chamfer and the interior drum, the lower Elastomeric component being located between the lower chamfer and the sealing cylinder whereby rotational motion of the rotational assembly will translate to axial raising of the reciprocating assembly to compress the Elastomeric components and seal the component in the neck of an oil reservoir.

5. The component as set forth in claim 1 and further including a repositionable cap (76) positioned above the interior drum (50), the repositionable cap having a lower portion (78) with a securement latch (86), the repositionable cap having a shiftable upper portion (82), a pivot pin (84) coupling the upper and lower portions, an L-shaped leg (86) formed in the upper portion to contact the securement latch during closing of the repositionable cap, a top Elastomeric component (88) ensures sealing of the upper and lower portions.

6. The component as set forth in claim 1 wherein the stick is a rigid dipstick.

7. The component as set forth in claim 1 wherein the stick is an assembly (100) formed of a rigid dipstick (102) formed with a spherical upper end, a cage-like support (104) receiving the spherical upper end whereby the rigid dipstick always depends in a vertical orientation under the influence of gravity.

8. The component as set forth in claim 1 wherein the stick is a flexible dipstick (108) whereby the flexible dipstick always depends in a vertical orientation under the influence of gravity.

9. The component as set forth in claim 1 and further including:

a shaft seal (136) on the center rotating member.

10. A locking stopper component (10) for selectively locking/sealing and uncovering of an oil reservoir of a tank/reservoir of a motorcycle in a secure tamper-free manner while precluding leakage when the motorcycle is tipped into an unintended orientation, the locking/sealing and uncovering and the precluding leakage being done in a safe, convenient and economical manner, the component comprising, in combination:

the component (10) having an upper extent (12) and a lower extent (14) and a central extent (16) between the upper and lower extents, the component having a normally vertical central axis, the component being in an essentially symmetrical configuration about the central axis;

the lower extent including an elongated dipstick (20) with a frusto-conical cam shoulder (22) formed in a central extent of the dipstick, the dipstick having a radial bore (24) there through above the shoulder;

a shaft seal (136) in the central extent (16) of the locking stopper component (10);

the upper extent including a lock (28) with a key (30) for insertion into the lock for rotation between locked and unlocked positions, the upper extent also including an upper shaft (32) and a lock housing (50) having a threaded recess above for threadedly receiving the upper shaft and the lock, the lock having an oval projection (34) below, a flat washer (36) and a spring (38) insure the sealed positioning of the shaft seal (136) and lock housing (50), upper shaft (32) and the lock (28);

the central extent (16) including a reciprocating assembly and a rotatable assembly;

the reciprocating assembly being formed of a split cylinder (40) and a sealing cylinder (42) and a cam cylinder (44), the sealing cylinder being located above and exteriorly of the split cylinder, the cam cylinder being located beneath and interiorly of the split cylinder, the cam cylinder having a downwardly facing spiral surface (46) in contact with the shoulder of the dipstick (20) whereby rotation of the dipstick and cam shoulder will cause the cam shoulder to ride along the spiral surface to translate the rotational movement of the dipstick and cam shoulder into axial reciprocating movement of the reciprocating assembly, a lower split ring (48) encircles the split cylinder (40) at the central extent (16) of the locking stopper component (10);

the rotatable assembly being formed of an interior drum (50) above and an exterior drum (52) below and the upper shaft (32) and the dipstick (20), a radial bore (56) (58) (60) (24) extending through interior drum and the exterior drum and the upper shaft and the dipstick, a cylindrical roll pin (62) extending through the radial bore to ensure concurrent rotational movement of all components of the rotatable assembly and preclude relative axial movement between components of the rotatable assembly, the exterior drum (52) being formed with an upper chamfer (64) and a lower chamfer (66), an upper split ring (68) encircles the split cylinder (40) at the central extent (16) of the locking stopper component (10);

a sealing assembly formed of an upper Elastomeric component (72) and a lower Elastomeric component (74), the upper Elastomeric component being located between the upper chamfer and the interior drum, the lower Elastomeric component (74) being located between the lower chamfer (66) and the sealing cylinder (42) whereby rotational motion of the rotational assembly will translate to axial raising of the reciprocating assembly to compress the upper and lower Elastomeric components (72) (74) and seal the component (10) in the neck of an oil reservoir; and a repositionable cap (76) positioned above the interior drum (50), the repositionable cap having a lower portion (78) with a securement latch (86), the repositionable cap having a shiftable upper portion (82), a pivot pin (84) coupling the upper and lower portions, a top Elastomeric component (88), an L-shaped leg (86) formed in the upper portion (82) to contact the top Elastomeric component (88) during closing of the repositionable cap (76), the top Elastomeric component (88) ensuring sealing of the upper and lower portions.

* * * * *